United States Patent [19]

de Concini et al.

[11] Patent Number: 4,805,575

[45] Date of Patent: Feb. 21, 1989

[54] FUEL MANIFOLD UNIT WITH INTEGRATED PRESSURE REGULATOR FOR THE FUEL INJECTION SYSTEM OF AN INTERNAL COMBUSTION ENGINE

[75] Inventors: Roberto de Concini, Zola Predosa; Rino Stagni, S. Pietro in Casale, both of Italy

[73] Assignee: Weber S.r.l., Torino, Italy

[21] Appl. No.: 120,971

[22] Filed: Nov. 16, 1987

[30] Foreign Application Priority Data

Nov. 18, 1986 [IT] Italy ..... 54100/86[U]

[51] Int. Cl.[4] ..... F02M 29/00

[52] U.S. Cl. ..... 123/468; 123/456; 123/467; 123/460

[58] Field of Search ..... 123/456, 460, 467, 468, 123/469, 452

[56] References Cited

U.S. PATENT DOCUMENTS

| | | | |
|---|---|---|---|
| 1,990,525 | 2/1935 | Vincent | 123/457 |
| 3,473,523 | 10/1969 | Hilborn | 123/457 |
| 4,205,637 | 6/1980 | Ito | 123/456 |
| 4,526,151 | 7/1985 | Tateishi | 123/468 |
| 4,570,600 | 2/1986 | Atkins | 123/468 |
| 4,570,601 | 2/1986 | Ito | 123/468 |
| 4,570,602 | 2/1986 | Atkins | 123/456 |
| 4,586,477 | 5/1986 | Field | 123/468 |
| 4,653,528 | 5/1987 | Field | 123/468 |

*Primary Examiner*—Carl S. Miller

*Attorney, Agent, or Firm*—Albert L. Jeffers; John F. Hoffman; Anthony Niewyk

[57] ABSTRACT

The unit is constituted by a manifold defining a fuel duct for fuel which is supplied to the injectors and by a pressure regulator operable to maintain the pressure of the fuel substantially constant within the manifold. The unit substantially comprises a chamber which is formed within and at one end of the said duct and which is separated from the remaining part of this duct by means of a separation element inserted into the duct itself and shaped in such a way as to define channels for the fuel between the chamber and the remaining part of the duct itself.

11 Claims, 2 Drawing Sheets

FUEL MANIFOLD UNIT WITH INTEGRATED PRESSURE REGULATOR FOR THE FUEL INJECTION SYSTEM OF AN INTERNAL COMBUSTION ENGINE

BACKGROUND OF THE INVENTION

The present invention relates to a supply unit for fuel injection apparatus of an internal combustion engine, comprising a manifold defining a duct for supplying the fuel to the injectors of the engine and a pressure regulator which can maintain the pressure of the fuel substantially constant within the manifold itself.

In fuel supply apparatus of this type it is very important to maintain the pressure of the fuel within the manifold substantially constant: for this purpose the manifold is provided with a connector to which is connected a pressure regulator of conventional type, substantially comprising a chamber in communication with the manifold and one wall of which is constituted by a deformable diaphragm, and a valve operable to put the manifold into communication with a discharge hole the opening of which is controlled by the said deformable diaphragm.

Known units comprising a manifold and a pressure regulator briefly described above have several disadvantages.

First of all they are structurally rather complex because of the numerous parts of which they are constituted and the connection members which are necessary to fix the pressure regulator to the manifold. Moreover, the pressure regulation effected by these units takes place with a certain delay because of the large volume of the ducts which connect the said chamber of the pressure regulator to the manifold. Finally, the unit thus formed has rather large dimensions which make its application in some types of motor vehicle problematical.

SUMMARY OF THE INVENTION

The object of the present invention is that of providing a unit of the first indicated type which will be free from the disadvantages which have been described and therefore will be structurally very simple, have a great operating rapidity and very reduced dimensions.

This object is achieved by means of a supply unit for fuel injection apparatus of an internal combustion engine comprising a manifold for supplying the said fuel to the injectors of the engine and a pressure regulator operable to maintain the pressure of the said fuel substantially constant within the said manifold, the said manifold defining a duct for the fuel and having a plurality of connectors which can be connected to the said injectors, the said presure regulator comprising a chamber for the fuel which is in communication with the said manifold duct and one wall of which is constituted by a deformable diaphragm, and a valve operable to put the said chamber into communication with a fuel discharge channel the opening of which is controlled by the said deformable diaphragm, characterised by the fact that the said chamber is formed within one end of the said manifold duct and is separated from the remaining parts of the duct itself by means of a separation element inserted in the duct itself, the said separation element being shaped in such a way as to define passages for the fuel between the said chamber and the said remaining part of the duct itself.

BRIEF DESCRIPTION OF THE DRAWINGS

For a better understanding of the present invention a more detailed description of it is now given by way of example with reference to the attached drawings, in which.

DETAILED DESCRIPTION OF THE INVENTION

Figure 1:
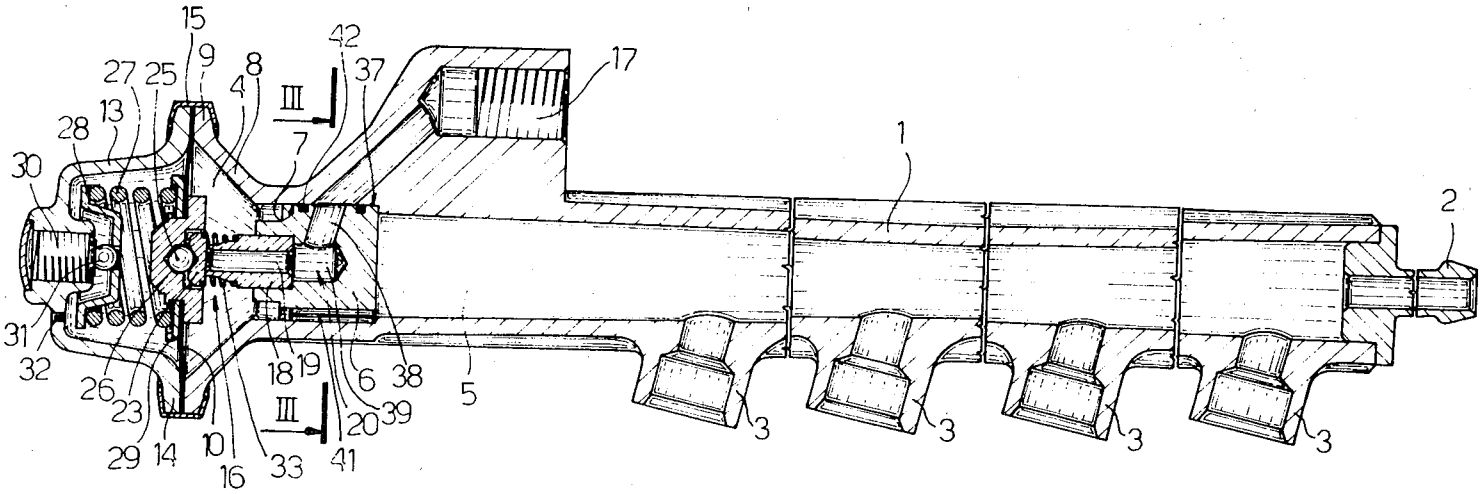
FIG. 1 is a longitudinal section of the unit of the present invention.

The unit of the invention forms part of fuel supply apparatus supplying fuel to the injectors of an internal combustion engine which includes a tubular manifold 1 which is in communication with a delivery pump for example by means of an end connector 2 and which has a plurality of connectors 3 through which the metering valves (injectors) deliver, on a suitable electric command, the quantity of fuel necessary to form the correct the pressurized mixture to supply to the internal combustion engine. According to the invention, within one end of the manifold 1 there is formed a chamber 4 which is separated from the duct 5 of the manifold itself by means of a separation element 6 which is substantially housed within a cavity 7 coaxial with the hole 5 and provided with an end shoulder.

Conveniently, the end of the manifold at which the chamber 4 is formed is cup-shaped as is clearly seen in FIG. 1, and therefore has a substantially conical wall 8 the peripheral edge 9 of which is orthogonal to the longitudinal axis of the manifold. The unit of the invention further includes a deformable diaphragm 10 the peripheral edges of which bear on the edge 9 of the wall 8 and are fixed with respect to it by a cover (13) also provided with an edge 14 orthogonal to the longitudinal axis of the manifold; the edges 9 and 14 are fixed together in any suitable way, for example by means of an annular element 15.

Figure 2:
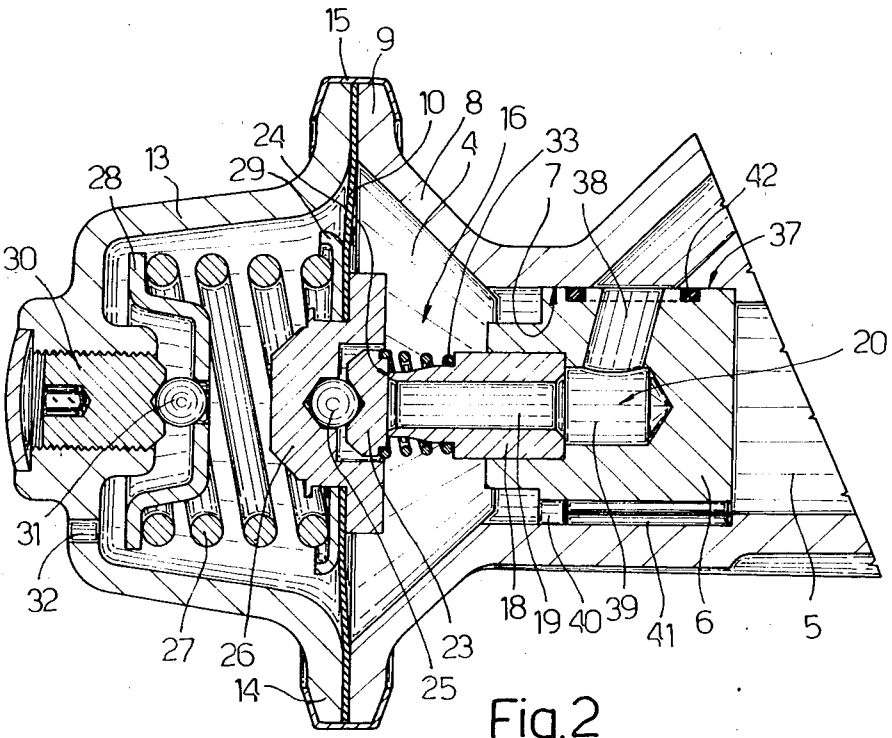
FIG. 2 illustrates, on an enlarged scale, an end part of the said unit.

The deformable diaphragm 10 constitutes one of the walls of the chamber 4 and it controls a valve 16 which is able to put the duct 5 of the manifold into communication with a discharge hole 17 formed in the manifold itself; this valve substantially comprises a bush 18 provided with an internal hole 19 which puts the chamber 4 into communication with the hole 17 through a passage 19 formed within the separation element 6. The valve 16 further includes an interception member 23 which can bear on a seat 24 formed on the end of the bush 18 in such a way as to close the hole 19 of the bush itself. The interception member 23 bears, via a ball 25, on a support member in the form of a disc 26 fixed in any convenient manner to the deformable diaphragm 10; on this element and on the interception member 23 there are formed corresponding conical seats for the ball 25 which can easily be seen in FIG. 2.

Between the cover 13 and the diaphragm 10 there is disposed a coil spring 27 which can exert a predetermined force on the diaphragm itself; conveniently it rests on appropriate end caps 28 and 29 the first of which is axially adjustable with respect to the cover 13 by means of an adjustment screw 30 on the end of which is formed a seat for a ball 31 which is interposed between the screw and the cap.

The cover 13 is provided with a hole 32 and another coil spring 33 is interposed between the interception member and a shoulder formed on the bush 18.

Figure 3:
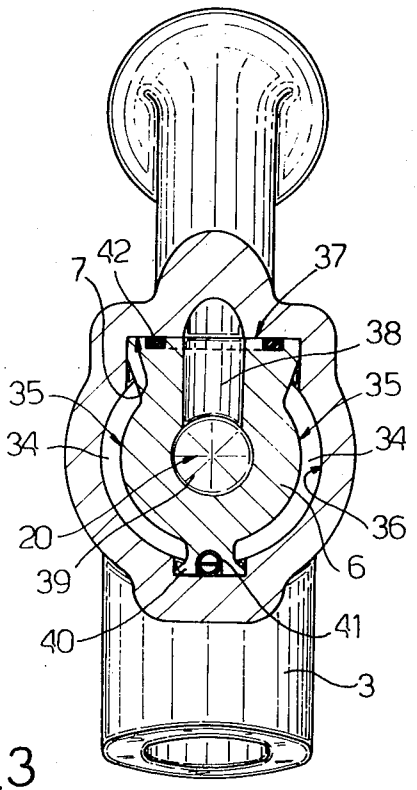
FIG. 3 is a section of the unit of FIG. 1 taken on the line III—III.

The separation element 6 is shaped in such a way as to define ducts 34 (FIG. 3) which put the duct 5 of the manifold into communication with the chamber 4; these ducts are formed, as is clearly seen in FIG. 3, between external surface portions 35 of the separation element 6 and the internal surface 36 of the cavity 7 in which the separation element itself is housed. This latter conveniently has a flat surface 37 (FIG. 3) into which opens a hole 38 in communication with an axial hole 39 which defines the duct 20 which puts the hole 19 within the bush 18 into communication with the discharge hole 17.

The separation element 6 has a radial projection 40 (FIG. 3) which is inserted in a corresponding axial groove of the cavity 7. An elastic pin 41 inserted in an axial hole of this projection locks the separation element with respect to the manifold.

Conveniently, between the surface 37 of the separation element 6 and the corresponding surface formed on the manifold there is interposed a sealing element 42.

The unit described operates in the following manner.

The pressure of the fuel within the interior of the duct 5 of the manifold 1 is transmitted into the chamber 4 through the ducts 34 formed between the separation element 6 and the internal surface 36 of the cavity 7; the coil spring 27 presses the diaphragm 10 towards the bush 18 in such as to hold the interception member 23 against the corresponding seat 24 of the bush itself to close the passage towards the discharge hole 17. When the pressure of the fuel within the chamber 4 exceeds a predetermined value, which depends on the force which the spring 27 exerts on this diaphragm and which is set by adjusting the screw 30, a displacement of the diaphragm towards the left of the Figure takes place and this causes separation of the interception element 23 from the corresponding seat: consequently part of the fuel can flow through the holes 19, 38 and 39 towards the discharge hole 17 in such a way as to reestablish the correct pressure value within the chamber itself and therefore in the duct of the manifold 5.

The spring 33 normally presses the interception element against the ball 25 and this against the support member 26 in such a way as to keep this ball constantly coupled with its corresponding conical seats formed on the first indicated parts.

It is evident that with the constructional arrangement which has been described a unit is formed in which the pressure regulator is strictly integrated with the manifold, with the advantage of considerably simplifying the structure of the unit itself whereby notably to reduce the dimensions, but above all to reduce the volume of the duct which puts the manifold into communication with the pressure regulator thereby obtaining regulation of the pressure in very short times.

It is evident that the embodiment of the present invention can have modifications and variations introduced thereto both as to form and to disposition of the various parts without by this departing from the ambit of the invention itself.

We claim:

1. A supply unit for fuel injection apparatus of an internal combustion engine comprising a manifold for supplying the said fuel to the injectors of the engine and a pressure regulator operable to maintain the pressure of the said fuel substantially constant within the said manifold, the said manifold defining a duct for the fuel and having a plurality of connectors which are connectable to the said injectors, the said pressure regulator comprising a chamber for the fuel which is in communication with the said manifold duct and one wall of which is constituted by a deformable diaphragm, and a valve operable to put the said chamber into communication with a fuel discharge channel the opening of which is controlled by the said deformable diaphragm, characterised by the fact that the said chamber is formed within one end of the said manifold duct and is separated from the remaining part of the duct by means of a separation element fitted in the duct itself, the said separation element being shaped in such a way as to define passages for the fuel between the said chamber and the said remaining part of the duct itself, said fuel passages being formed between portions of outer surfaces of the said separation element and inner surfaces of the said duct.

2. A unit according to claim 1, characterised by the fact that a first section of the said discharge channel is formed within the said separation element and a second section of this discharge channel is formed in the said manifold, between the said two channel sections there being interposed a sealing washer of annular form operable to seal the fuel within the channel itself.

3. A unit according to claim 2, characterised by the fact that the said first section of said discharge channel section formed in the said separation element comprises an axial hole and a substantially radial hole communicating with one another, the said radial hole opening on to a first substantially flat surface of the said separation element, and the said manifold including a corresponding second flat surface from which the said second channel section extends and which can be coupled with the said first flat surface, the said annular sealing washer being interposed between the said two flat surfaces.

4. A unit according to claim 2, characterised by the fact that a resilient element is interposed between the said separation element and the said manifold, said element resiliently operable to press the said first flat surface against the said second flat surface.

5. A unit according to claim 4, characterised by the fact that the said resilient element comprises a resilient pin inserted between the said manifold and the said separation element in a position which, with respect to the axis of the manifold, is substantially opposite the position in which the said flat surfaces are located.

6. A unit according to claim 1, characterised by the fact that the said end of the manifold is closed by a cover which is operable to fix the peripheral edge of the said diaphragm to the said manifold, the said manifold end being cup shaped and having a peripheral edge substantially orthogonal to the axis of the said manifold and forming an abutment seat for the said peripheral edge of the said deformable diaphragm.

7. A unit according to claim 1, characterised by the fact that the said valve includes a bush provided with a hole for placing the said chamber into communication with the said discharge channel and a seat formed on one end of the said bush, an interception member operable to contact the said seat to close the said hole, a support element for the said interception member fixed to the central part of the said deformable diaphragm and a ball interposed between the interception member and the support element, the said unit further including a spring interposed between the said cover and the said diaphragm and operable to press the said diaphragm towards the said bush.

8. A unit according to claim 7, characterised by the fact that the said interception member and the said support element are each provided with a conical seat for the said ball.

9. A unit according to claim 1, characterised by the fact that the said cover has a cup shape form and defines with the said deformable diaphragm a second member in communication with the atmosphere and in which the said spring is housed.

10. A unit according to claim 7, characterised by the fact that a second spring acts on the said interception member and is interposed between the interception member and the said bush.

11. A unit according to claim 7, characterised by the fact that the said bush is inserted in an axial hole of the said separation element.

* * * * *